US008289149B2

(12) United States Patent
Teramoto

(10) Patent No.: US 8,289,149 B2
(45) **Date of Patent: *Oct. 16, 2012**

(54) AIR COMPRESSOR

(75) Inventor: Kazuhiro Teramoto, Shizuoka (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/371,791

(22) Filed: Feb. 13, 2012

(65) Prior Publication Data

US 2012/0143379 A1 Jun. 7, 2012

Related U.S. Application Data

(63) Continuation of application No. 12/388,575, filed on Dec. 19, 2009, now Pat. No. 8,179,249.

(30) Foreign Application Priority Data

Aug. 28, 2008 (JP) ..... 2008-220212

(51) Int. Cl.
*G08B 1/00* (2006.01)

(52) U.S. Cl. ..... 340/532; 340/425.5; 340/426.24; 340/426.25; 340/457.4

(58) Field of Classification Search ..... 340/532, 340/425.5, 426.24, 426.25, 457.4, 679, 680
See application file for complete search history.

(56) References Cited

U.S. PATENT DOCUMENTS

| | | | | |
|---|---|---|---|---|
| 4,480,961 | A | 11/1984 | Kono et al. | |
| 6,343,251 | B1 * | 1/2002 | Herron et al. | 701/100 |
| 6,558,444 | B1 | 5/2003 | Hunter | |
| 2005/0027586 | A1 * | 2/2005 | Bacon et al. | 705/10 |
| 2005/0166612 | A1 | 8/2005 | Allison et al. | |
| 2008/0050280 | A1 * | 2/2008 | Fujita | 422/67 |
| 2009/0133419 | A1 | 5/2009 | Matsuno et al. | |

FOREIGN PATENT DOCUMENTS

| | | |
|---|---|---|
| CN | 1624231 | 6/2005 |
| JP | 8-48133 | 2/1996 |
| JP | 08-048133 | 2/1996 |
| JP | 2003-254253 | 9/2003 |
| JP | 2004-286243 | 10/2004 |

* cited by examiner

*Primary Examiner* — Daryl Pope
(74) *Attorney, Agent, or Firm* — Antonelli, Terry, Stout & Kraus, LLP.

(57) ABSTRACT

A control method for an air compressor including a compressor body for compressing air and an item to be replaced used during the operation of the compressor body. The method includes computing a service time of the item to be replaced, being based upon an operating time of the compressor body, discriminating whether the item to be replaced is a manufacturer's recommended item or not, determining whether or not the service time of the item to be replaced discriminated as the manufacturer's recommend item is not longer than a first reference time, but determining whether or not the service time of the item to be replaced discriminated as one which is not the manufacturer's recommended item is not longer than a preset second reference time which is shorter than the first reference time, and issuing an alarm when determining that the reference time is exceeded.

15 Claims, 9 Drawing Sheets

| | REFERENCE TIME | |
|---|---|---|
| | RECOMMENDED ITEM | SUBSTITUTE |
| BELT | 12000 | 10000 |
| SUCTION FILTER | 8000 | 7000 |
| SEPARATOR ELEMENT | 6000 | 5000 |
| OIL FILTER | 6000 | 4000 |

FIG.6

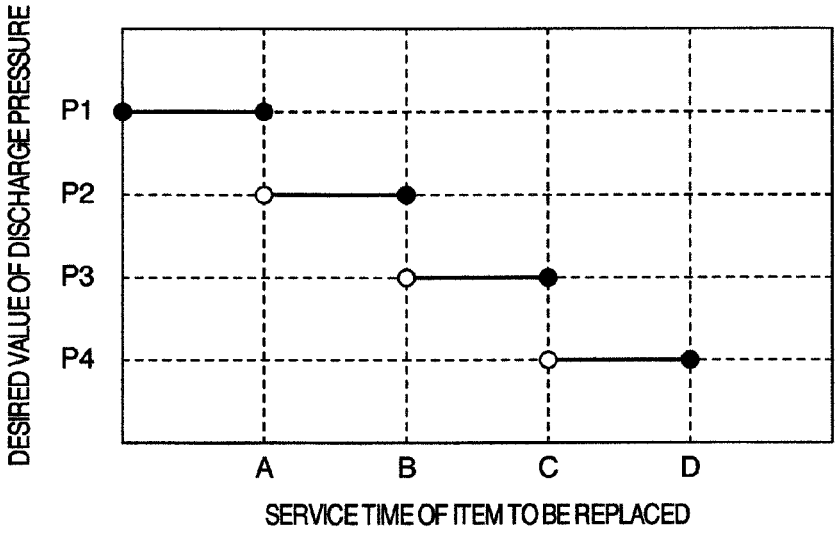

FIG.7

| BELT | REFERENCE TIME A1 | EXCESS TIME B1 | EXCESS TIME C1 | EXCESS TIME D1 |
|---|---|---|---|---|
| (RECOMMENDED) | 12000 | 13000 | 14000 | 15000 |
| (SUBSTITUTE) | 10000 | 11000 | 12000 | 13000 |
| SUCTION FILTER | REFERENCE TIME A2 | EXCESS TIME B2 | EXCESS TIME C2 | EXCESS TIME D2 |
| (RECOMMENDED) | 8000 | 8500 | 9000 | 9500 |
| (SUBSTITUTE) | 7000 | 7500 | 8000 | 8500 |
| SEPARATOR ELEMENT | REFERENCE TIME A3 | EXCESS TIME B3 | EXCESS TIME C3 | EXCESS TIME D3 |
| (RECOMMENDED) | 6000 | 6500 | 7000 | 7500 |
| (SUBSTITUTE) | 5000 | 5500 | 6000 | 6500 |
| OIL FILTER | REFERENCE TIME A4 | EXCESS TIME B4 | EXCESS TIME C4 | EXCESS TIME D4 |
| (RECOMMENDED) | 6000 | 6500 | 7000 | 7500 |
| (SUBSTITUTE) | 4000 | 4250 | 4500 | 4750 |

FIG.11

| | WEIGHTING FACTOR | |
|---|---|---|
| | RECOMMENDED ITEM | SUBSTITUTE |
| BELT (i=1) | 0.8 | 2.0 |
| SUCTION FILTER (i=2) | 0.6 | 1.0 |
| SEPARATOR ELEMENT (i=3) | 0.8 | 2.0 |
| OIL FILTER (i=4) | 1.0 | 3.0 |

AIR COMPRESSOR

CROSS REFERENCE TO RELATED APPLICATION

This application is a continuation of U.S. application Ser. No. 12/388,575, filed Feb. 19, 2009, now U.S. Pat. No. 8,179,249, the contents of which are incorporated herein by reference.

INCORPORATION BY REFERENCE

The present application claims priority from Japanese application JP2008-220212 filed on Aug. 28, 2008, the content of which is hereby incorporated by reference into this application.

BACKGROUND OF THE INVENTION

The present invention relates to an air compressor together with items to be replaced, which are used during the operation of the compressor body.

Periodical replacement of items to be replaced (spare parts) is indispensable for an air compressor in order to use the air compressor in a safe and efficient condition for a long time. As specific examples of items to be replaced for an air compressor of oil feed type (in detail, oil is fed into the working chamber of the air compressor body), there may be exemplified a belt for transmitting a power between a compressor body and a motor, a suction filter provided in the suction side of the compressor body, for removing impurities from intake air, lubrication oil to be fed into the compressor body, a separator element for removing lubrication oil from compressed air produced from the compressor body, an oil filter for removing impurities from the lubricant oil, and the like. It is preferable to replace these items in dependence upon replacement interval periods stipulated in a maintenance manual.

Further, heretofore, there has been proposed a vehicle air-conditioner comprising an adding-up and recording means for adding up operating times of a compressor, a maintenance interval period setting means for previously setting maintenance periods (for example, cleaning periods or replacement interval periods for a dust removing filter, packing, seals, ducts, belts and the like) appropriate for parts for which the maintenances are required, a comparing means for comparing an operating time recorded in the adding-up and recording means, with a maintenance interval period delivered from the maintenance period setting means, and a display means for displaying the situation that the operating time becomes equal to a maintenance interval period (refer to, for example, JP-A-8-48133 (Patent Document 1)). The above-mentioned conventional technology is adapted to enhance the executing rate of maintenance by displaying the situation that the maintenance interval period expires, thereby it is possible to reduce failures caused by inferior maintenance.

Moreover, there has been proposed, for example, an engine driven heat pump comprising a timer for counting a service time of engine oil (in detail, an added-up operating time of an engine until the oil is exchanged), a display control means for controlling a display unit in accordance with a service time of the engine oil, and a function restraining means for restraining the operating function of the engine in accordance with a service time of the engine oil (refer to, for example, JP-A-2004-286243 (Patent Document 2)). In this conventional technology, the characters "Check" is displayed on the display unit when the service time of the engine oil comes up to 9,800 hours (in other words, the time at which the exchange of engine oil is required, is approached), and thereafter, when the service time of the engine oil comes up to 10,000 hours (that is, comes up to the time at which the exchange of engine oil is required), the characters "L8" which indicates an operating condition of restricting the function of the engine, together with the characters "Check", and the speed of the engine is restricted. That is, even though the exchange of engine oil has not yet been carried after the time of requiring the exchange of engine oil, the extended time operation of the engine is carried out under the restricted operating function of the engine without stopping the operation of the engine in order to satisfy the user's demand, more or less. Further, it is possible to allow the user to recognize the time of requiring a maintenance in view of not only the characters "Check" but also lowering of the operating function of the engine.

The above-mentioned conventional technology has raised the following problems. Namely, the items to be replaced include two kinds, that is, manufacturer's recommended items and substitutes (in other others, those other than the manufacturer's recommended items), and in general, the substitutes have shorter replacement interval periods in comparison with the manufacturer's recommended items although they are inexpensive. Further, in the conventional technology, should the timing of display of an expirations of a replacement interval period (or a restraint to the operating function due to the expiration of the replacement interval period) be set being based upon the replacement interval period of a manufacturer's recommended item, the timing would be delayed in the case of using a substitute thereof. Thus, there would be a possibility of longer time using of the substitute exceeding the replacement interval period inherent to the substitute. Thus, there have been raised a scope for improvements in view of safeties.

SUMMARY OF THE INVENTION

An object of the present invention is to provide an air compressor which can cope with items to be replaced, other than manufacturer's recommended items, so as to enhance the safety thereof.

To the end, according to the first aspect of the present invention, there is provided an air compressor incorporating a compressor body for compressing air, and an item to be replaced, which is used during operation of the compressor body, and further comprising a service time computing means for computing a service time of the item to be replaced, being based upon an operating time of the compressor body, a discriminating means for discriminating whether the item to be replaced is a manufacturer's recommended item or not, a determining means for determining whether or not the service time of the item to be replaced exceeds a preset first reference time in the case of the service time of the item to be replaced which is discriminated as a manufacturer's recommended item, but determining whether or not the service time exceeds a second reference time previously set so as to be shorter than the first reference time in the case of the service time of the item to be replaced, which has been discriminated as the one other than the manufacturer's recommended item, and an alarming means for issuing an alarm when the determining means determines that the service time exceeds the associated reference time.

In the first aspect of the present invention, if, for example, an item to be replaced is not a manufacturer's recommended item, an alarm is issued being based upon a reference time (replacement interval period) which is shorter than that of the manufacturer's recommended item, thereby it is possible to allow the user to recognize expiration of the replacement interval period. Accordingly, an item to be replaced can be prevented from being used for an excessively long time even though the item to be replaced is the one other than a manufacturer's recommended item, thereby it is possible to enhance the safety.

In order to achieve the above-mentioned objects, according to a second aspect of the present invention, there is provided an air compressor incorporating a compressor body for compressing air, and an item to be replaced, which is used during operation of the compressor body, and further comprising a service time computing means for computing a service time of the item to be replaced, being based upon an operating time of the compressor body, a discriminating means for discriminating whether the item to be replaced is a manufacturer's recommended item or not, a determining means for determining whether or not the service time of the item to be replaced exceeds a preset first reference time in the case of the service time of the item to be replaced which is discriminated as the manufacturer's recommended item, but determining whether or not the service time exceeds a preset second reference time previously set so as to be shorter than the first reference time in the case of the service time of the item to be replaced, which has been discriminated as the one other than the manufacturer's recommended item, and an operation control means for restraining the operating function of the compressor or stopping the operation of the compressor body when the determining means determines the service time exceeds the associated reference time.

In the second aspect of the present invention, if the item to be replaced is not a manufacturer's recommended item, the operating function of the compressor is restrained or the operation of the compressor is stopped, being based upon the reference time (replacement interval period) which is shorter than that of the manufacturer's recommended item, thereby it is possible to allow the user to recognize expiration of the replacement interval period and as well to urge the user to replace the item to be replaced with new one. Accordingly, an item to be replaced can be prevented from being used for an excessively long time even though the item to be replaced is the one other than a manufacturer's recommended item, thereby it is possible to enhance the safety.

In order to achieve the above-mentioned objects, according to a third aspect of the present invention, there is provided an air compressor incorporating an compressor body for compressing air and a plurality of items to be replaced, which are used during the operation of the compressor body, and further comprising a service time computing means for respectively computing service times of the items to be replaced, being based upon an operating time of the compressor body, a discriminating means for respectively discriminating whether or not the items to be replaced are manufacturer's recommended items, a determining means multiplying a service time of an item to be replaced which is discriminated as a manufacturer's recommended item, with a preset first factor, or multiplying a service time of an item to be replaced which is discriminated as the one other than a manufacturer's recommended item, with a second factor preset so as to be larger than the first factor, and computing a total time from the service times, as parameters, of the plurality of items to be replaced which are multiplied by the factors, for determining whether or not the total time exceeds a preset reference time, and an operation control means for restraining the operating function of the compressor or stopping the operation of the compressor body if the total time is determined to exceed the reference time.

In the third aspect of the present invention, since the total time is computed from the service times, as parameters, of the plurality of items to be replaced, which are multiplied by the factors larger than those of the manufacturer's recommended items, in the case of the items to be replaced which are not manufacturer's recommended items, and then, the total time is compared with the reference time, it may be said that the reference time is relatively shorter in the case of an item to be replaced, which is not a manufacturer's recommended item, than that of in the case of an item to be replaced which is a manufacturer's recommended item. Further, the operating function of the compressor is restrained or the operation of the compressor body is stopped, being based upon the above-mentioned reference time, and accordingly, it is possible to allow the user to recognize expiration of a maintenance interval period, and to urge the user to replace an item to be replaced with new one. Thus, in the present invention, even though an item to be replaced is not the one which is a manufacturer's recommended item, it is possible to prevent the item to be replaced from being used, for an excessively long time, thereby it is possible to enhance the safety.

According to a fourth aspect of the present invention, there is provided an air compressor as stated in the second or third aspect of the present invention, wherein the operation control means preferably lowers a desired value of discharge pressure of the compressor body so as to restrain the operating function of the compressor.

According to a fifth aspect of the present invention, there is provided an air condition as stated in any one of the second to fourth aspects of the present invention, preferably further comprising an inverter for variably controlling the speed of the compressor body, wherein the operation control means lower the upper limit of the variable control range of the speed of the compressor body so as to restrain the operating function of the compressor.

According to a sixth aspect of the present invention, there is provided an air compressor as stated in any one of the second to fifth aspects of the present invention, wherein if the determining means determines that the reference time is exceeded by an excess value, the operation control means preferably restrain the operating function of the compressor, being based up the excess value.

According to a seventh aspect of the present invention, there is provided an air compressor as stated in any one of the first to sixth aspects of the present invention, wherein the item to be replaced is any of the following items, that is, a belt for transmitting a power between the compressor body and a motor, a suction filter provided on the suction side of the compressor body, for removing impurities from intake air, lubrication oil to be fed into the compressor body, a separator element for separating the lubrication oil from compressed air produced in the compressor body, and an oil filter for removing impurities from the lubrication oil.

According to an eighth accept of the present inventions, there is provided an air compressor as stated in any one of the first to seventh aspects of the present invention, wherein the item to be replaced incorporates an IC chip storing therein identification data and adapted to carry out data processing, and the discriminating means discriminates whether or not the item to be replaced is a manufacturer's recommended item, being based upon the identifying data stored in the IC chip incorporated in the item to be replaced.

According to the present invention, it is possible to cope with the item to be replaced, which is not a manufacturer's recommended item, thereby, improving the security.

BRIEF DESCRIPTION OF THE DRAWINGS

FIG. 6 is a view showing an example of a setting table in the control device in the second embodiment of the present invention;

FIG. 7 is a view for explaining operation control characteristics of the control device in the second embodiment of the present invention, that is, relationships between a service time and a desired discharge pressure as to items to be replaced are shown;

FIG. 11 is a view illustrating an example of a setting table in the control device in the third embodiment of the present invention.

DETAILED DESCRIPTION OF PREFERRED EMBODIMENTS

Explanation will be made of a first embodiment of the present invention with reference to FIGS. 1 and 2.

Figure 1:
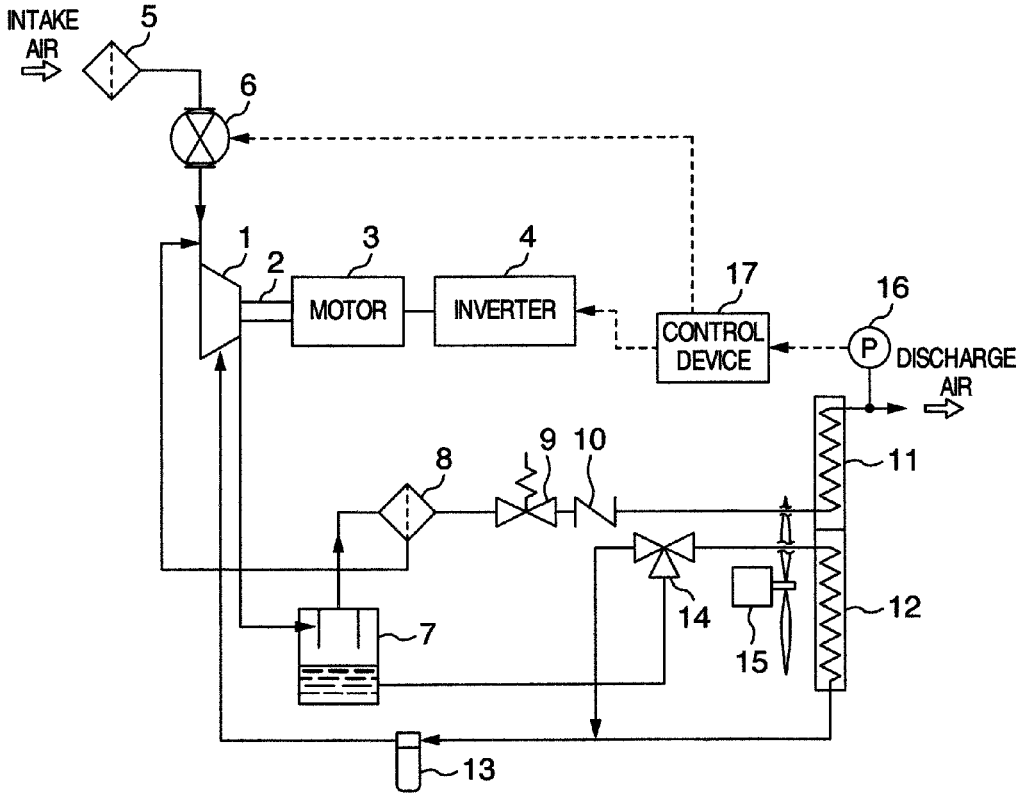
FIG. 1 is a schematic view illustrating an example of the configuration of an air compressor for which the present invention is applied.

The configuration of an air compressor, as an example, upon which the present invention is applied is shown in FIG. 1 which is a schematic view.

Referring to FIG. 1, the oil feed type compressor incorporates a compressor body 1 for compressing air, a motor 3 transmitting a power through the intermediary of a belt 2, for driving the compressor body 1, an inverter 4 for controlling the speed of the motor 3, a suction filter 5 provided on the intake side of the compressor body 1, for removing impurities from intake air, an intake throttle valve 6 provided on the intake side of the compressor body 1, an oil tank 7 provided on the discharge side of the compressor body 1, for primarily separating lubrication oil from compressed air, a separator element 8 for secondarily separating lubrication oil from the compressed air separated in the oil tank 7, and an after cooler 11 introducing therein the compressed air separated by the separator element 8, by way of a pressure regulating valve 9 and a check valve 10, for cooling the compressed air.

The lubrication oil separated by the separator element 8 is fed to the intake side of the compressor body 1. Meanwhile, the lubrication oil separated in the oil tank 7 is fed to components (such as bearings and a working chamber) within the compressor body 1 by way of, for example, an oil cooler 12 for cooling the lubrication oil and an oil filter 13 for removing impurities from the lubrication oil. Further, there are provided a bypass system bypassing the oil cooler 12, and a temperature regulating valve (three-way valve) 14 for regulating the ratio between a flow rate of the lubrication oil flowing toward the oil cooler 12 and a flow rate of the lubrication oil flowing into the bypass system, arranged in the upstream connection part of the bypass system. The temperature regulating valve 14 regulates the ratio between the cooled flow rate and the bypass flow rate in accordance with a temperature of the lubrication oil from the oil tank 7 in order to adjust the temperature of the lubrication oil to be fed into the compressor body 1. It is noted that the after cooler 11 and the oil cooler 12 are heat-exchangers of air-cooled type, and is adapted to be cooled by cooling air blown from a cooling fan 15.

Further, a pressure sensor 16 for detecting a discharge pressure of the compressor body 1 is provided downstream of the after cooler 11, and the pressure sensor 16 delivers a detection signal to a control device 17.

The control device 17 computes, as a first function (operation control), a deviation between a detected value of a discharge pressure detected by and delivered from the pressure sensor 16 and a predetermined desired value which has been previously set, and delivers a speed instruction signal which has been created being based upon the deviation, to the inverter 4. The inverter 4 delivers a frequency depending upon the speed instruction signal to the motor 3 in order to variably control the speed of the motor 3 (that is, the speed of the compressor body 1).

Further, if, for example, the detected value of the discharge pressure is increased up to a predetermined upper limit value which has been previously set after the speed of the compressor body 1 is lowered down to the lower limit value of the variable control range, the control device 17 closes the intake throttle valve 6 while it maintains the speed of the compressor body 1 at the lower limit value (no load operation). Further, if, for example, the detected value of the discharge pressure is decreased during no load operation, down to a predetermined lower limit which has been previously set, the control device 17 opens the intake throttle valve 6 (load operation). Further, if, for example, the duration time of the no load operation exceeds a preset predetermined time, the control device 17 stops the compressor body 1.

Further, the control device 17 is adapted to, as a second function (replacement time display control), discriminate whether or not a plurality of items to be replaced, mounted on the air compressor, (in detail, the belt 2, the suction filter 5, the separator element 8 and the oil filter 13) are manufacturer's recommended items, and to compute their service times on the basis of an operating time of the compressor body 1 so as to issue an alarm if the service time of any one of the items to be replaced exceeds an associated reference time (replacement interval period). Detailed explanation will be hereinafter made of the above-mentioned replacement time display control.

Figures 2, 3:
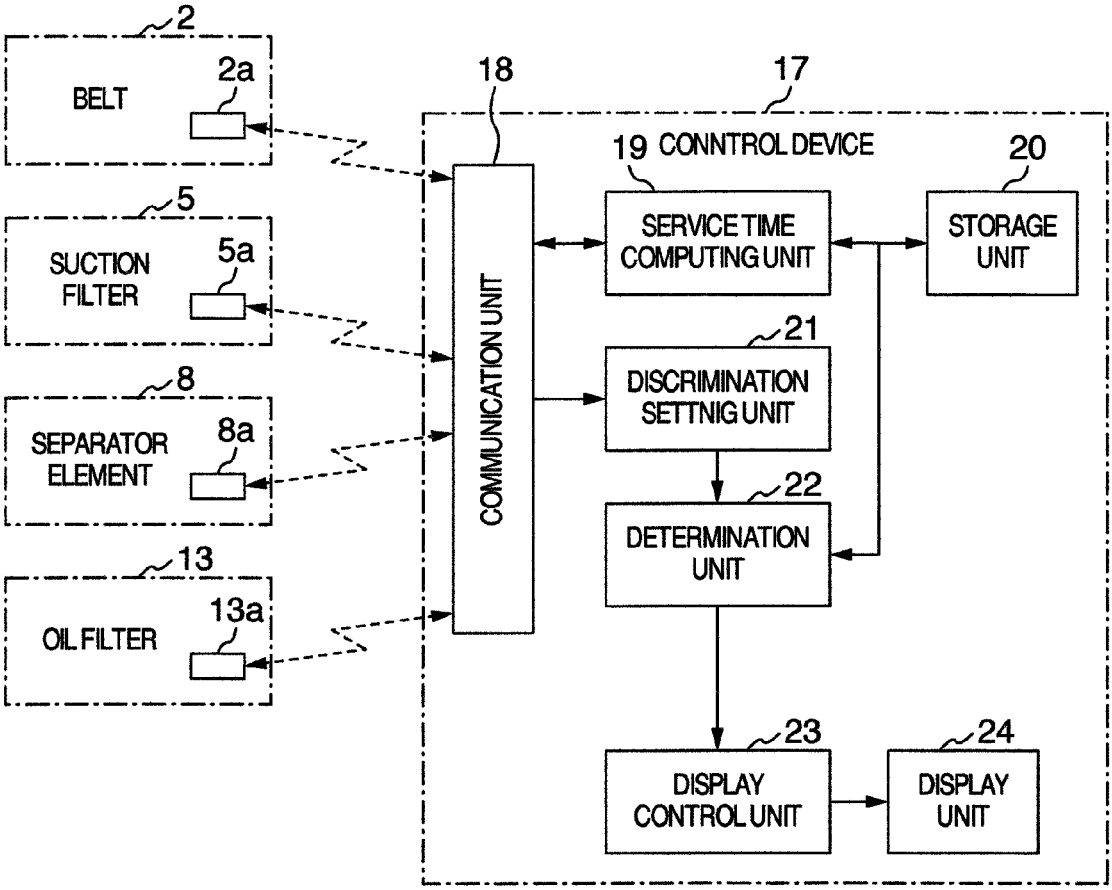
FIG. 2 is a block diagram illustrating a functional configuration of a control device relating to the display control of replacement timing according to a first embodiment of the present invention.
FIG. 3 is view showing an example of a setting table in the control device in the first embodiment of the present invention.

FIG. 2 is a block diagram which shows the functional configuration of the control device 17 relating to the replacement time display control.

Referring to FIG. 2, the control device 17 comprises communication unit 18, a service time computing unit 19, a storage unit 20, a discrimination setting unit 21, a determination unit 22, a display control unit 23 and a display unit 24.

The belt 2, the suction filter 5, the separator element 8 and the oil filter 13 incorporate IC chips 2*a*, 5*a*, 8*a*, 13*a*, respectively. Each of the IC chips 2*a*, 5*a*, 8*a*, 13*a* includes a memory storing therein identification data (in detail, indicating, for example, kind data which exhibits a belt, a suction filter, an oil filter, a separator element or the like, a manufacture's serial number inherent to the associated item, identification data which exhibit a manufacturer's recommended item and the like), an antenna for wireless data communication, and a control and computation unit for controlling reading and writing and communication of data.

The communication unit 18 in the control device 17 carries out wireless communication with the IC chip 2*a* of the belt 2, the IC chip 5*a* of the suction filter 5, the IC chip 8*a* of the separator element 8 and the IC chip 13*a* of the suction filter 13 in the air compressor. In detail, it delivers instructions for transmitting identification data, to the IC chips 2*a*, 5*a*, 8*a*, 13*a*, and accordingly, receives the identification data transmitted from the IC chips 2*a*, 5*a*, 8*a* and 13*a*.

The service time computing unit 19 in the control device 17 determines whether the manufacturer's serial number of each of the items to be replaced, which has been received through the communication unit 18 coincides with the last time manufacturer's serial number stored in the storage unit 20. If, for example, it is not coincident with the last time manufacturer's serial number (in other words, the item to be replaced was already replaced), the identification data stored in the storage unit 20 is rewritten into the identification data (in particular, the manufacturer's serial number) which has been received by way of the communication unit 18. Further, respective operating times of the compressor body 1 are added up, being based upon signal outputs to, for example, the inverter 4, and the thus added-up operating time is stored as a service time of an item to be replaced in the storage unit 20 in relation to the identification data (in particular, the kind data and the manufacturer's serial number). Meanwhile, if, for example, the manufacturer's serial number is coincident with the last time manufacturer's serial number (in other words, if an item to be replaced has not yet replaced), the service time computing unit 19 reads thereinto the last time service time stored in the storage unit 20, as an initial value, and adds the operating time of the compressor body 1 to this initial value, and rewrites the thus added time as a servicer time of an item to be replaced into the storage unit 20.

The discrimination setting unit 21 in the control device 17 discriminates whether or not each of the items to be replaced is a manufacturer's recommended item, being based upon the identification data of the item to be replaced, which has been received by way of the communication unit 18, and then sets a reference time for the item to be replaced in reference to a setting table. Specifically, in view of data on the setting table as shown in FIG. 3, if it is discriminated that, for example, the belt 2 is the manufacturer's recommended item, the operating time is set to 12,000 hours, but if it is discriminated that the belt 2 is a substitute (that is, which is not a manufacturer's recommended item), the reference time is set to 10,000 hours which is shorter than the afore-mentioned reference time. Further, if it is discriminated that the suction filter 5 is a manufacturer's recommended item, the reference time is set to 8,000 hours, but if it is discriminated that it is a substitute, the reference time is set to 7,000 hours which is shorter than the afore-mentioned reference time. Further, in the case of the discrimination that the separator element 8 is a manufacturer's recommended item, the reference time thereof is set to 6,000 hours, but in the case of the discrimination that it is a substitute, the reference time is set to 5,000 hours which is shorter than the former. Further, in the case of the discrimination that the oil filter 13 is a manufacturer's recommended item, the reference time thereof is set to 6,000 hours, but in the case of the discrimination that it is a substitute, the reference time is set to 4,000 hours which is shorter than the former. It is noted that if, for example, an item to be replaced which has no IC chip, is mounted in the air compressor, the discrimination setting unit 21 cannot receive any identification data by way of the communication unit 18, and accordingly, it is determined that the item to be replaced is not a manufacturer's recommended item.

The determination unit 22 in the control device 17 compares the service time of each item to be replaced, which is computed by the service time computing unit 19, with the reference time of each of the item to be replaced, which is set in the discrimination setting unit 21. Then, if, for example, the service time of an item to be replaced exceeds the reference time, the determination unit 22 delivers a display instruction to the display control unit 23 which displays thereon, for example, a kind of the item to be replaced on a display unit (for example, a liquid crystal monitor) together with a message indicating the expiration of the replacement interval period, in response to the display instruction.

In this embodiment which is configured as stated above, the control device 17 discriminates, being based upon identification data received from an IC chip of an item to be replaced, whether the item to be replaced is a manufacturer's recommended item or not. Then, it determines whether the service time of the item to be replaced, which is discriminated as a manufacturer's recommended item, exceeds the preset first reference time or not, but it determines whether the service time of the item to be replaced, which is discriminated as the one that is not a manufacturer's recommended item, exceeds the preset second reference time which is shorter than the first reference time, or not. Then, if, for example, it is determined that the service time of the item to be replaced, which is discriminated as the manufacturer's recommended item, exceeds the first reference time, or if it is determined that the item to be replaced, which is discriminated as the one that is not the manufacturer's recommended item, exceeds the second reference time, the control device 17 displays the expiration of the replacement interval period of the item to be replaced. Thus, in this embodiment, an alarm is issued in view of the reference time (replacement interval period) depending upon whether or not an item to be replaced is a manufacturer's recommended item in order to enable the user to know the expiration of the replacement interval period. Thus, it is possible to prevent an item to be replaced from being used in a longer time even though the item to be replaced is the one which is not a manufacture's recommended item, thereby it is possible to enhance the safety.

It is noted in the above-mentioned first embodiment that although explanation has been made of the display unit 24 which displays, for example, a message indicating the expiration of the replacement interval period, as an alarming means, the present invention should not be limited thereto, that is, there may be used, for example, a buzzer or a lamp, instead thereof. Even such a variant example may exhibits technical effects and advantages similar to those stated above.

Explanation will be made of a second embodiment of the present invention with reference to FIGS. 4 to 7. In this embodiment, if the service time of any one of a plurality of items to be replaced exceeds the associated reference time, the operating function of the compressor is stepwise restrained, being based upon the thus excess value. It is noted that like reference numerals are used to denote like parts to those explained in the first embodiment in order to suitably abbreviate the explanation thereto.

Figure 4:
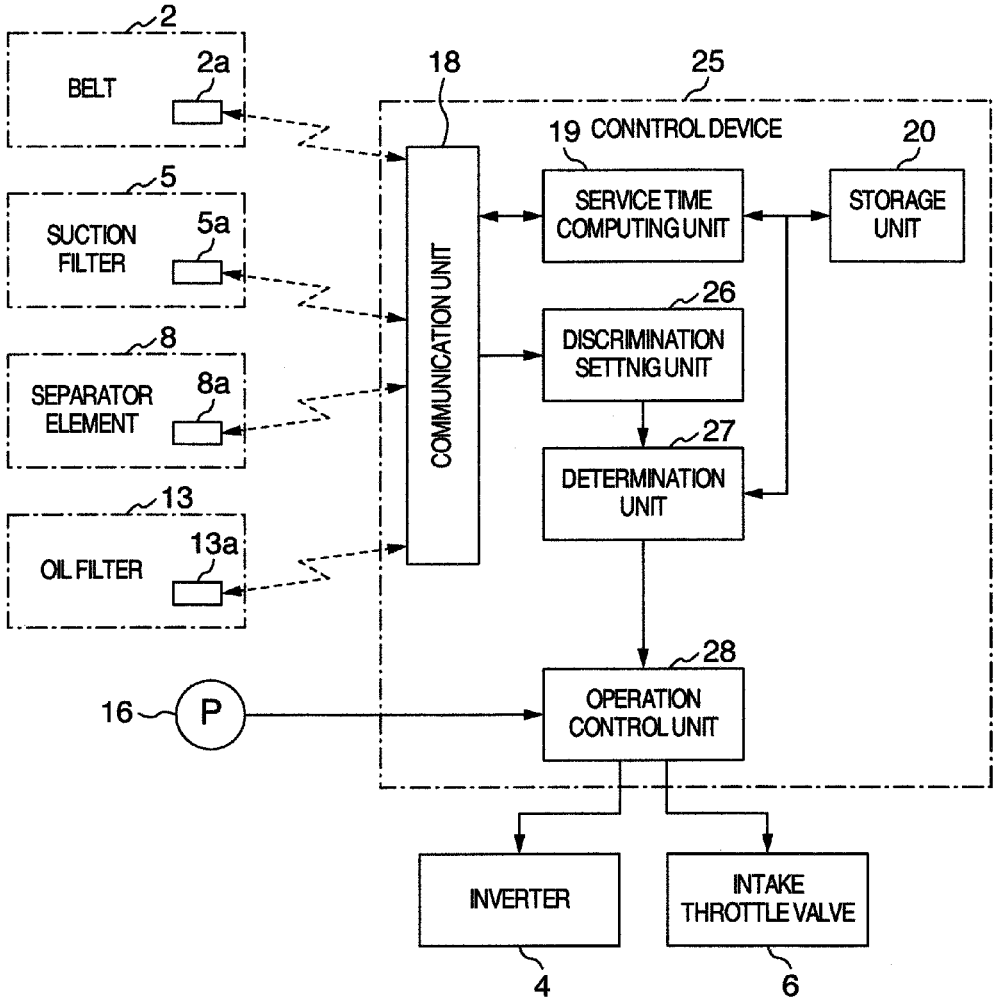
FIG. 4 is a block diagram illustrating a functional configuration of a control device relating to the operation control in a second embodiment of the present invention.

FIG. 4 is a block diagram which shows the functional configuration of a control device in relation to the operation control in the embodiment. Referring to FIG. 4, the control device 25 comprises the communication unit 18, the service time computing unit 19, the storage unit 20, a discrimination setting unit 26, a determination unit 27 and an operation control unit 28.

Figure 5:
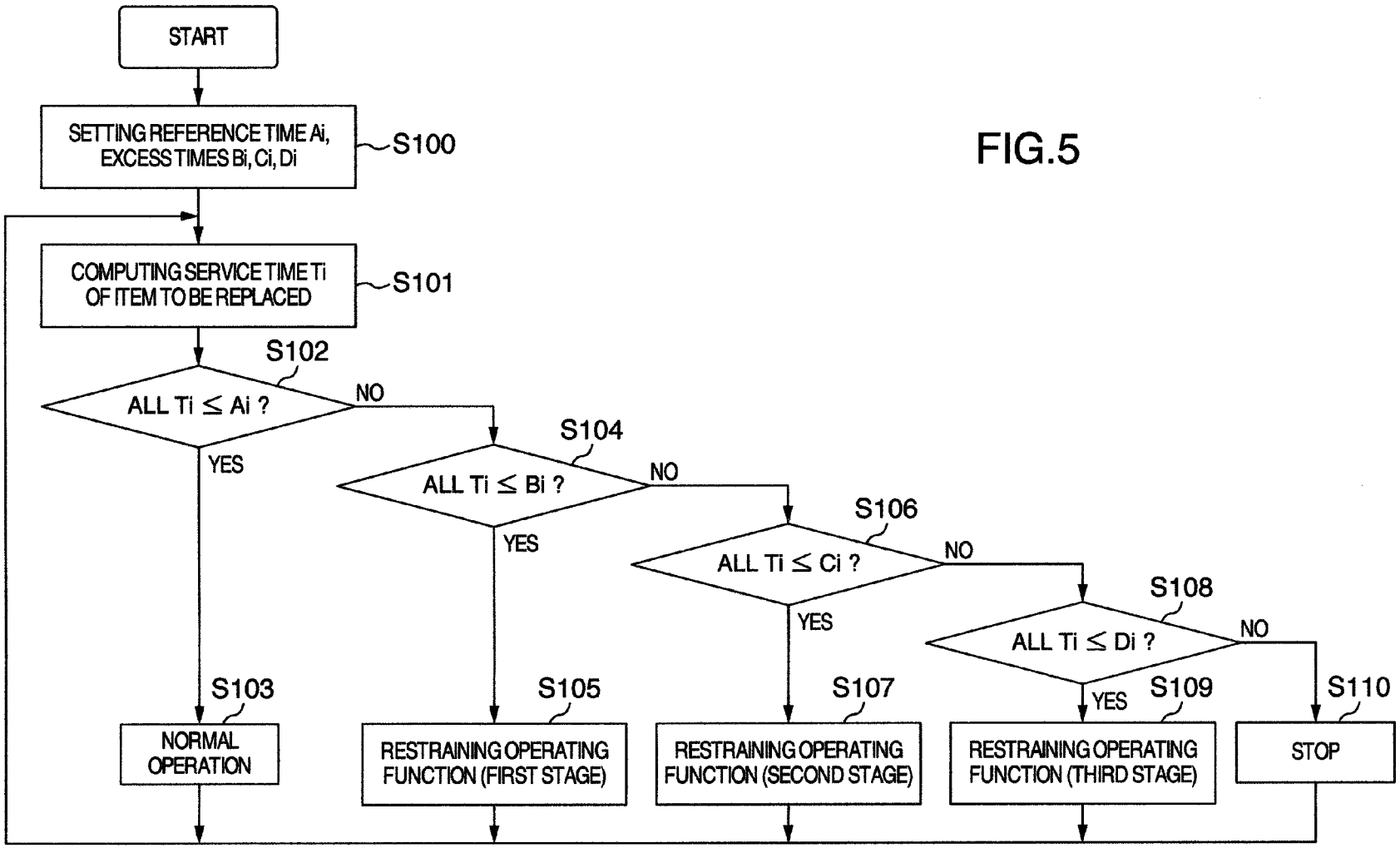
FIG. 5 is a flow chart for explaining the content of a process relating to the operation control of the control device in the second embodiment of the present invention.

FIG. 5 is a flowchart which shows process steps in relation to the operation control of the control device 25. Further, FIG. 6 is a view exhibiting an operation control characteristic of the control device 25, indicating the relationship between the service time of an item to be replaced and a desired value of discharge pressure.

At first, at step 100, the discrimination setting unit 26 discriminates whether or not each of items to be replaced (in detail, the belt 2, the suction filter 5, the separator element 8 or the oil filter 13) is a manufacturer's recommended item, being based upon identification data of each item received by way of the communication unit 18, and sets a reference time Ai and excess times Bi, Ci, Di (where Ai<Bi<Ci<Di), in reference to a setting table which has been previously stored. Specifically, for example, with reference to, for example, a setting table as shown in FIG. 7, if the belt 2 is discriminated as a manufacturer's recommended item, there are set the reference time A1=12,000 hours, the excess times B1=13,000 hours, C1=14,000 hours, and D1=15,000 hours, but if it is discriminated as a substitute, there are set in general shorter times, that is, the reference time A1=10,000 hours, and the excess times B1=11,000 hours, C1=12,000 hours and D1=13,000 hours. Further, if the suction filter 5 is discriminated as a manufacturer's recommended item, there are set the reference time A2=8,000 hours, and excess times B2=8,500 hours, C2=9,000 hours and D2=9,500 hours, but if it is discriminated as a substitute, there are set in general shorter times, that is, A2=7,000 hours, the excess periods B2=8,500 hours, C2=8,000 hours and D2=8,500 hours. Further, the separator element 8 is discriminated as the manufacturer's recommended item, there are set the reference time A3=6,000 hours, the exceeded times B3=6,500 hours, C3=7,000 hours and D3=7,500 hours, but it is discriminated as a substitute, there are in general set shorter times, that is, the reference time A3=5,000 hours, the excess time B3=5,500 hours, C3=6,000 hours and D3=6,500 hours. Further, if the oil filter 13 is discriminated as a manufacturer's recommended item, there set the reference time A4=6,000 hours, and the excess times B4=6,500 hours, C4=7,000 hours and D4=7,500 hours, but if it is discriminated as a substitute, there are in general set shorter times, that is, the reference time A4=4,000 hours, the excess times B4=4,250 hours, C4=4,500 hours and D4=4,750 hours.

Further, at step 101, the service time computing unit 19 computes the service times Ti of the respective items to be replaced (in detail, the service time T1 of the belt 2, the service time T2 of the suction filter 5, the service time T3 of the separator element 8 and the service time T4 of the oil filter 13) from the operating time of the compressor body 1.

Further, at step 102, the determination unit 27 compares the service time Ti of each of the items to be replaced, computed by the service time computing unit 19, with a reference time Ai set by the discrimination setting unit 26 so as to determine, for example, whether each of the service times Ti of the item to be replaced is not longer than the associated reference time Ti or not. If, for example, all service times Ti are not longer than the respective reference times Ai, the determination at step 102 is satisfied, and step 103 is carried out. At step 103, the operation control unit 28 sets a desired value of the discharge pressure to P1 in order to carry out the normal operation of the air compressor. Further, a deviation between the desired value P1 and a detected value of the discharge pressure is computed, and then a speed instruction signal based upon this deviation is delivered to the inverter 4. Further, the upper and lower limit values of the discharge pressure are set being based upon the desired value P1 of the discharge pressure as a reference in order to open and close the intake throttle valve 6 in dependence upon these limit values. Meanwhile, if, for example, the service time of any one of the item to be replaced exceeds the associated excess time at step 102, the above-mentioned determination is not satisfied, and accordingly, step 104 is carried out.

At step 104, the determination unit 27 determines whether the service times Ti of all items to be replaced are not longer than the respective excess times Bi or not. For example, if the service times of all items to be replaced are not longer than the respective excess times Bi, the determination at step 104 is satisfied, and accordingly, step 105 is carried out. At step 105, the operation control unit 28 sets a desired value of the discharge pressure to P2 (where P2<P1) in order to carry out restraint to the operating function at a first stage. Further, deviation between the desired pressure P2 of the discharge pressure and a detected value of the discharge pressure is computed, and a speed instruction signal produced being based upon the deviation is delivered to the inverter 4. Further, the upper limit value and the lower limit value of the discharge pressure are set being based upon the desired value P2 of the discharge pressure as a reference in order to open and close the intake throttle value 6 in dependence upon the upper and lower limit values. Meanwhile, if, for example, the service time Ti of any one of the items to be replaced exceeds the associated excess time Bi at step 104, the determination is not satisfied, and accordingly, step 106 is carried out.

At step 106, the determination unit 27 determines whether the service times Ti of all items to be replaced are not longer than the respective excess times Ci or not. For example, if the service times Ti of all items to be replaced are not longer than the respective excess times Ci, the determination at step 106 is satisfied, and accordingly, step 107 is carried out. At step 107, the operation control unit 28 sets a desired value of the discharge pressure to P3 (where P3<P2) in order to carry out restraint to the operating function at a second stage. Further, a deviation between the desired value P3 of the discharge pressure and a detected value of the discharge pressure is computed, and a speed instruction signal obtained being base upon the deviation is delivered to the inverter 4. Further, the upper limit value and the lower limit value of the discharge pressure are set being based upon the desired value P3 of the discharge pressure as a reference, and the intake throttle valve 6 is closed and opened being based upon these limit values. Meanwhile, if, for example, the service time Ti of any one of the item to be replaced exceeds the associated excess time Bi at step 106, the determination is not satisfied, and accordingly, step 108 is carried out.

At step 108, the determination unit 27 determines whether the service times Ti of all items to be replaced are not longer than the respective excess times Di or not. If, for example, the service times Ti of all items to be replaced are not longer than the respective exceeded times Di, the determination at step 108 is satisfied, and accordingly, step 109 is carried out. At step 109, the operation control unit 28 sets a desired value of the discharge pressure to P4 (where P4<P3) in order to carry out restraint to the operating function at a third stage. Further, a deviation between the desired value P4 of the discharge pressure and a detected value of the discharge pressure is computed, and a speed instruction signal obtained being based upon this deviation is delivered to the inverter 4. Further, the upper limit value and the lower limit value of the discharge pressure are set being based upon the desired value P4 of the discharge pressure as a reference, and accordingly, the intake throttle valve 6 is closed and opened being based upon these upper and lower limit values. Meanwhile, if, for example, the service time of any one of the items to be replaced exceeds the associated excess time Di at step 108, the determination is not satisfied, and accordingly, step 110 is carried out. At step 110, the operation control unit 28 stops the operation of the compressor body 1.

In this embodiment configured as stated above, the control device 25 determines whether the service time Ti of the item to be replaced which is discriminated as a manufacturer's recommended item, exceeds the preset first reference time Ai or not, similar to the control unit 17 in the first embodiment, but determines whether or not the service time Ti of the item to be replaced which is discriminated as the one which is not a manufacturer's recommended item, exceeds the second reference time Ai which has been preset so as to be shorter than the first reference time. Further, if, for example, it is determined that the service time Ti of any one of the items to be replaced exceeds the associated reference time Ti, the operating function of the compressor is stepwise restrained in dependence upon the excess value. Thus, in this embodiment, the operating function of the compressor is restrained being based upon the reference time (replacement interval period) which depends upon whether an item to be replaced is a manufacturer's recommended item or not, in order to enable the user to know the expiration of the replacement interval period, thereby it is possible to urge the user to replace the item to be replaced with new one. Thus, even though the item to be replaced is not a manufacturer's recommended item, it is possible to prevent the item to be replaced from being used in a longer time, thereby it is possible to enhance the safety.

Figure 8:
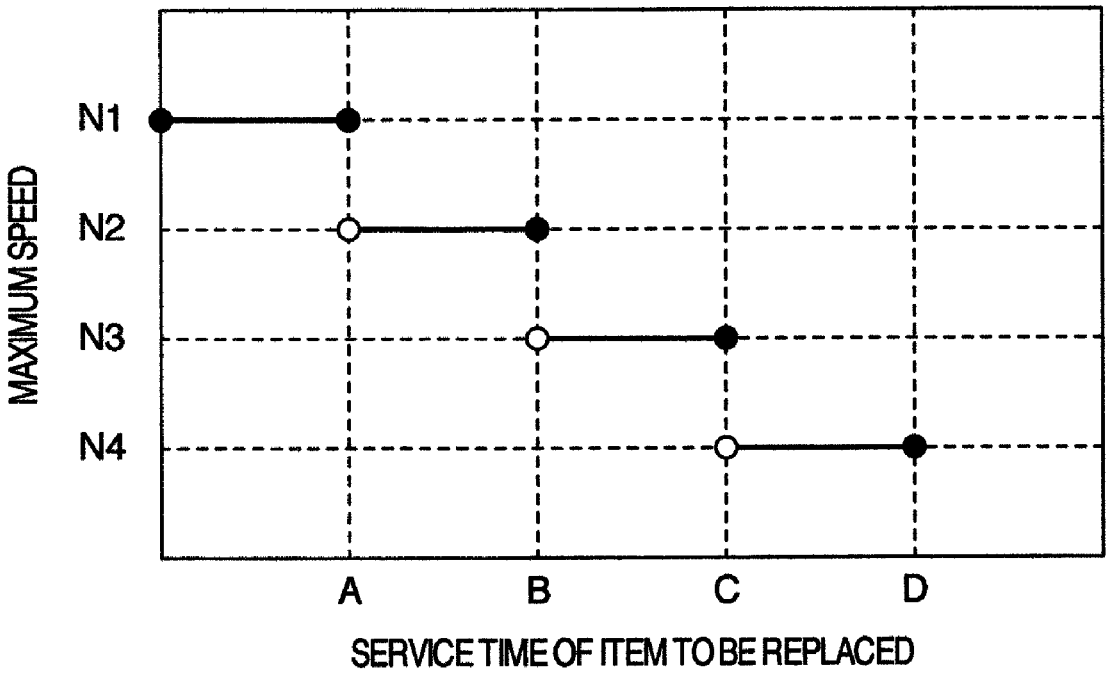
FIG. 8 is a view for explaining operation control characteristics of the control device in an variant form of the present invention, that is, relationships between a service time and a maximum speed of a compressor body, as to items to be replaced are shown.

It is noted that explanation has been made of, in this second embodiment, the configuration, as an example, that the control device 25 lowers stepwise the desired value of the discharge pressure, that is, P1 to P2 to P3 to P4, so as to stepwise restrain the operating function of the compressor. The present invention should not be limited to this configuration. That is, for example, as shown FIG. 8, the maximum speed of the compressor body 1 (in other words, the upper limit value of the variable speed control range) controlled by the inverter 4 may be stepwise decreased, that is, N1 to N2 to N3 to N4, so as to stepwise restrain the operating function of the compressor. Further, for example, the desired value of the discharge pressure and the maximum speed of the compressor body may be both stepwise lowered so as to stepwise restrain the operating function of the compressor. Even in these variant forms of the embodiment, technical effects and advantages similar to those stated above can be obtained.

Further, in the second embodiment, although there has been explained the configuration that if the service time Ti of any one of the items to be replaced exceeds the reference time Ai, the control device 25 restrains stepwise the operating function of the compressor in dependence upon the excess value, and further if it exceeds the excess time Di, the control device 25 stops the operation of the compressor, the present invention should not be limited to this configuration. That is, for example, the compressor body itself may be stopped if the service time Ti of any one of the items to be replaced exceeds the associated reference time Ai. Even in this variant form of the embodiment, technical effects and advantages similar to those stated above may be obtained.

Further, although no explanation has been specifically explained in the second embodiment, the control device 25 may control the display of the expiration of replacement interval period, similar to the control device 17 in the first embodiment.

Explanation will be made of a third embodiment of the present invention with reference to FIGS. 9 to 11. In this embodiment, the total time is computed from the service times of a plurality of items to be replaced as parameters, and the operating function of the compressor body is restrained if the total time exceeds a reference time. It is noted in this embodiment, like reference numerals are used to denote parts like to those explained in the second embodiment or the like so as to suitably abbreviate the explanation thereto.

Figure 9:
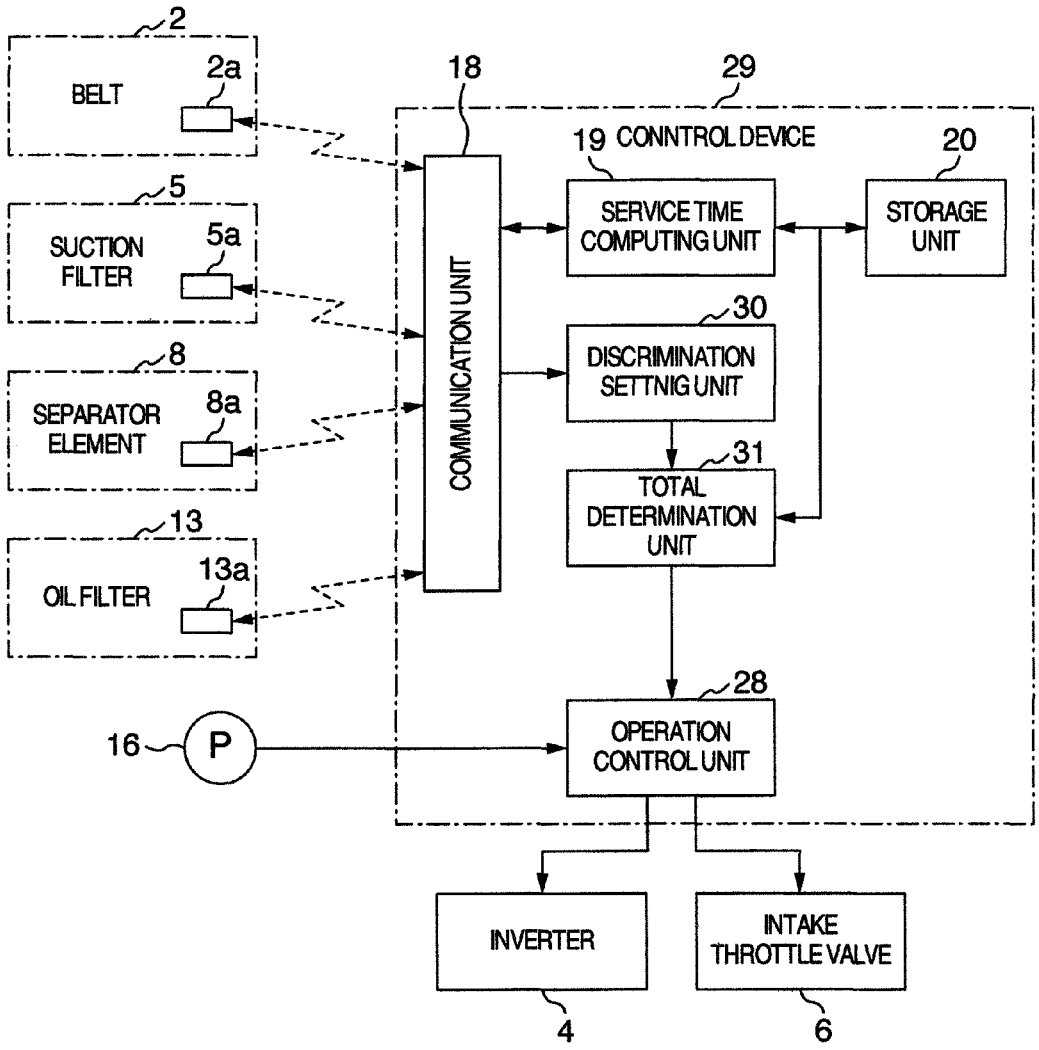
FIG. 9 is a block diagram illustrating a functional configuration of the control device relating to operation control in a third embodiment of the present invention.

FIG. 9 is a block diagram which shows a functional configuration relating to the operation control in this embodiment. In FIG. 9, a control device 29 comprises the communication unit 18, the service time computing unit 19, the storage unit 20, a discrimination setting unit 30, a total determination unit 31 and the operation control unit 28.

Figure 10:
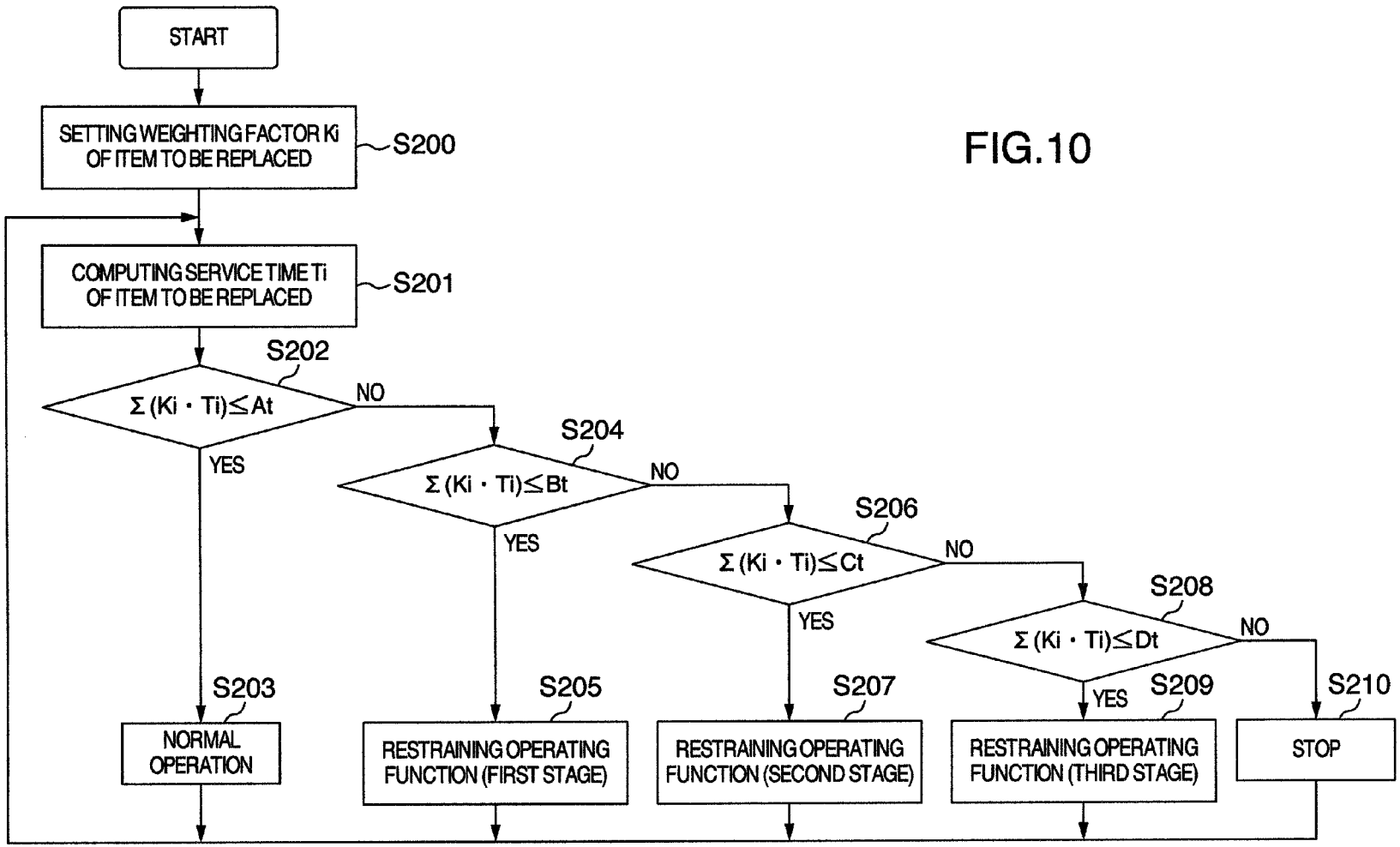
FIG. 10 is a flow chart for explaining the content of a process relating to the operation control of the control device in the third embodiment of the present invention.

FIG. 10 is a flowchart which exhibits process steps relating to the operation control in this embodiment.

At first at step 200, the discrimination setting unit 30 discriminates whether items to be replaced (in detail, the belt 2, the suction filter 5, the separator element 8 and the oil filter 13) are manufacturer's recommended items or not, being based upon identification data received by way of the communication unit 18 or not, and sets weighting factors Ki for the item to be replaced, in reference to a setting table which has been previously stored. Specifically, as in a setting table shown in FIG. 11, if the belt 2 is discriminated as a manufacturer's recommended item, the weighting factor K1 is set to 0.8, but if it is discriminated as a substitute, the weighting factor K1 is set to 2.0 which is larger than the afore-mentioned value. Further, if the suction filter 5 is discriminated as a manufacturer's recommended item, a weighting factor K2 is set to 0.6, but if it is discriminated as a substitute, the weighting factor K2 is set to 1.0 which is larger than the afore-mentioned value. Further, the separator element 8 is discriminated as a manufacturer's recommended item, a weighting factor K3 is set to 0.8, but if it is discriminated as a substitute, the weighting factor K3 is set to 2.0 which is larger the afore-mentioned value. Further, the oil filter 13 is discriminated as a manufacturer's recommended item, a weighting factor K4 is set to 1.0, but if it is discriminated as a substitute, the weighting factor K4 is set to 3.0 which is larger than the afore-said value.

Then, at step 201, the service time computing unit 19 computes the service times Ti of the items to be replaced (in detail, the service time T1 of the belt 2, the service time T2 of the suction filter 5, the service time T3 of the separator element 8 and the service time T4 of the oil filter 13) from the operating time of the compressor body 1.

Then, at step 202, the total determination unit 31 multiplies the service times Ti of the items to be replaced computed by the service time computing unit 19, respectively by the weighting factors Ki set by the discrimination setting unit 30, and then computes the total time which is obtained by adding up the thus multiplied values. Further, it determines whether the total time is not longer a preset reference time At or not. For example, if, for example, the total time is not longer than the reference time At, the determination at step 202 is true, and accordingly, step 203, the operation control unit 28 controls the compressor which therefore carries out normal operation. Meanwhile, if, for example, the total time exceeds the reference time At, the determination at step 202 is false, and accordingly, step 204 is carried out.

At step 204, the total determination unit 31 determines whether the total time is not longer than a preset excess time Bt (where Bt>At) or not. If the total time is not longer than the excess time Bt, the determination at step 204 is true, and accordingly at step 205, the operation control unit 28 controls the compressor so as to carry out restraint to the operating function at a first stage. Meanwhile, if the total time exceeds the excess time Bt, the determination at step 102 is false, and accordingly, step 206 is carried out.

At step 206, the total determination unit 31 determines whether the total time is not longer than a preset excess time Ct (where Ct>Bt) or not. If, for example, the total time is not longer than the excess time Ct, the determination at step 206 is true, and accordingly, at step 207, the operation control unit 28 controls the compressor so as to carry out restraint to the operating function at a second stage. Meanwhile, the total times exceeds the excess time Ct, the determination at step 206 is false, and accordingly, the step 208 is carried out.

At step 208, the total determination unit 31 determines whether the total time is not longer than a preset excess time Dt (where Dt>Ct) or not. If, for example, the total time is not longer than the excess time Dt, the determination at step 208 is true, and accordingly, at step 209, the operation control unit 28 controls the compressor so as to carry out restraint to the operating function at a third stage. Meanwhile, if, for example, the total time exceeds the excess time Dt, the determination at step 208 is false, and accordingly, at step 210, the operation control unit 28 stops the operation of the compressor body 1.

In this embodiment having the configuration, as stated above, the control device 29 multiples the service time Ti of the item to be replaced discriminated as a manufacture's recommended item, by the preset first weighting factor Ki, but multiplies the service time Ti of the item to be replaced discriminated as the one which is not the manufacturer's recommended item, by the preset second weighting factor Ki which is larger than the former, and computes the total time (ΣKi*Ti) from the service times of a plurality of items to be replaced which have multiplied by the weighting factors Ki, as parameters, and determines whether the total time (ΣKi*Ti) exceeds the reference time At or not. Further, if, for example, it is determined that the total time (ΣKi*Ti) exceeds the reference time At, the operating function of the compressor is stepwise restrained, depending upon the thus excess value. Accordingly, in this embodiment, the operating function of the compressor is restrained at the time when the total time which is computed depending upon whether each of the items to be replaced is a manufacturer's recommended item or not exceeds the reference time, and accordingly, the user can know the occasion that the time of maintenance for the compressor has come in order to urge the user to replace an item to be replaced with new one. Thus, even though an item to be replaced is the one which is not a manufacturer's recommended item, it is possible to prevent the same being used for a longer time, thereby it is possible to enhance the safety.

It is noted in the afore-mentioned third embodiment that explanation has been made of the example in which the service times of the items to be replaced, each being multiplied by the weighting factor Ki, are added up so as to obtain the total time. However, the present invention should not limited to this process. That is, the computation may be carried out in another way, that is, another formula may be used, as far as the service times Ti of the items to be replaces, each being multiplied by the weighting factor Ki are used as parameters. Even in this variant form of the embodiment, technical effects and advantages similar to those as stated above can be obtained.

Further, in the third embodiment as stated above, although explanation has not be specifically made, the control device 29 may also carry out the control of display of the time of expiration of the replacement interval period.

Further, in the first to third embodiments, although explanation has not be specifically made, the control device may transmits the service times to the IC chip so as to write the same in the IC chips of the item to be replace. In this variant form, even though, for example, a second hand item to be replaced is additionally mounted in the compressor, the control device acquires the past service time stored in the IC chip of the second hand item to be replaced, and accordingly, the control device 17 can compute the service time in view of the past used time as an initial value.

Further, in the first to third embodiments, explanation has been made of the configuration that the control device receives identification data stored in the IC chip of the item to be replaced, and discriminates whether the item to be replaced is a manufacturer's recommended item or not, being based upon the received identification data. The present invention should not be limited thereto. That is, the control device may discriminates whether an item to be replaced is a manufacturer's recommended item or not, being based upon bar codes, hologram or the like provided to the item to be replaced and read by a reader. Further, as to an item to be replaced to which an IC chip, barcodes or the like cannot be directly applied (for example, lubrication oil), the IC chip or the barcodes may be applied to, for example, an attachment to the item to be replaced (for example, a container in which the lubrication oil is reserved). Further, for example, the control device may discriminate whether an item to be replaced is a manufacturer's recommended item or not, being based upon data inputted from a keyboard. Even in these variant example, technical effects and advantages similar to those as stated above can be obtained.

It is noted that as stated above, explanation has been made of, as an example, the air compressor of an oil feed type in which the speed of the compressor body is variably controlled, as the subject to which the present invention is applied. The present invention should not be limited to this air compressor. That is, the present invention may be applied to an air compressor which is operated while the speed of a compressor body is fixed. Further, the present invention may be also applied to, for example, an air compressor of oil-less type. Even in these variant forms, technical effects and advantages similar to those as stated above can be obtained.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A control method for an air compressor including a compressor body for compressing air, and an item to be replaced used during the operation of the compressor body, the method comprising the steps of:

computing a service time of the item to be replaced, being based upon an operating time of the compressor body, discriminating whether the item to be replaced is a manufacturer's recommended item or not, determining whether or not the service time of the item to be replaced, which has been discriminated as the manufacturer's recommend item, is not longer than a first reference time, but determining whether or not the service time of the item to be replaced, which has been discriminated as one which is not the manufacturer's recommended item, is not longer than a second reference time which has been preset so as to be shorter than the first reference time, and issuing an alarm when determining that the reference time is exceeded.

2. The control method for the air compressor as set forth in claim 1, wherein the item to be replaced has an IC chip for storing therein identification data and for processing data, the method further comprising the step of discriminating whether or not the item to be replaced is a manufacturer's recommended item, being based upon identification data stored in the IC chip of the item to be replaced.

3. The control method for the air compressor as set forth in claim 1, wherein the item to be replaced is any one of a belt for transmitting a power between the compressor body and a motor, a suction filter provided on the suction side of the compressor body, for removing impurities from intake air, lubrication oil fed into the compressor body, a separator element for separating the lubrication oil from compressed air discharged from the compressor body, and an oil filter for removing impurities from the lubrication oil.

4. A control method for an air compressor including a compressor body for compressing air, and an item to be replaced used during the operation of the compressor body, the method comprising the steps of:

computing a service time of the item to be replaced, being based upon an operating time of the compressor body, discriminating whether the item to be replaced is a manufacturer's recommended item or not, determining whether or not the service time of the item to be replaced, which has been discriminated as the manufacturer's recommend item, is not longer than a first reference time, but determining whether or not the service time of the item to be replaced, which has been discriminated as one which is not the manufacturer's recommend item, is not longer than a second reference time which has been preset so as to be shorter than the first reference time, and restraining the operating function of the compressor or stopping the compressor if it is determined that the reference time is exceeded.

5. The control method for the air compressor as set forth in claim 4, wherein a desired value of the discharge pressure of the compressor body is lowered so as to restrain the operating function of the compressor.

6. The control method for the air compressor as set forth in claim 4, further comprising the step of variably controlling the speed of the compressor body, wherein the upper limit value of a variable control range of the speed of the compressor body is lowered so as to restrain the operating function of the compressor.

7. The control method for the air compressor as set forth in claim 4, wherein, when it is determined that the reference time is exceeded, the operating function of the compressor is restrained stepwise being based upon the excess value.

8. The control method for the air compressor as set forth in claim 4, wherein the item to be replaced has an IC chip for storing there identification data and for processing data, the method further comprising the step of discriminating whether or not the item to be replaced is a manufacturer's recommended item, being based upon identification data stored in the IC chip of the item to be replaced.

9. The control method for the air compressor as set forth in claim 4, wherein the item to be replaced is any one of a belt for transmitting a power between the compressor body and a motor, a suction filter provided on the suction side of the compressor body, for removing impurities from intake air, lubrication oil fed into the compressor body, a separator element for separating the lubrication oil from the compressed air discharged from the compressor body, and an oil filter for moving impurities from the lubrication oil.

10. A control method for an air compressor including a compressor body for compressing air, and a plurality of items to be replaced used during the operation of the compressor body, the method comprising the steps of:

computing service times of the items to be replaced, being based upon an operating time of the compressor body, discriminating whether or not the items to be replaced are manufacturer's recommend item, respectively, multiplying the service time of the item to be replaced, which have been discriminated as the manufacturer's recommended items, by a preset first factor, but multiplying the service times of the item to be replaced, which have discriminated as the one which is not the items to be replaced, by a second factor which has been preset so as to be larger than the first factor, and computing a total time from the service times of the plurality of items to be replaced, which are multiplied by these factors, as parameters, for determining whether or not the total time exceeds a preset reference time, and restraining the operating function of the compressor or stopping the compressor if it is determined that the reference time is exceeded.

11. The control method for the air compressor as set forth in claim 10, wherein a desired value of the discharge pressure of the compressor body is lowered so as to restrain the operating function of the compressor.

12. The control method for the air compressor as set forth in claim 10, further comprising the step of variably controlling the speed of the compressor body, wherein the upper limit value of a variable control range of the speed of the compressor body is lowered so as to restrain the operating function of the compressor.

13. The control method for the air compressor as set forth in claim 10, wherein, when it is determined that the reference time is exceeded, the operating function of the compressor is restrained stepwise being based upon the excess value.

14. The control method for the air compressor as set forth in claim 10, wherein the item to be replaced has an IC chip for storing therein identification data and for processing data, the method further comprising the step of discriminating whether or not the item to be replaced is a manufacturer's recommended item, being based upon identification data stored in the IC chip of the item to be replaced.

15. The control method for the air compressor as set forth in claim 10, wherein the item to be replaced is any one of a belt for transmitting a power between the compressor body and a motor, a suction filter provided on the suction side of the compressor body, for removing impurities from intake air, lubrication oil fed into the compressor body, a separator element for separating the lubrication oil from compressed air discharged from the compressor body, and an oil filter for removing impurities from the lubrication oil.

* * * * *

UNITED STATES PATENT AND TRADEMARK OFFICE

CERTIFICATE OF CORRECTION

PATENT NO. : 8,289,149 B2
APPLICATION NO. : 13/371791
DATED : October 16, 2012
INVENTOR(S) : K. Teramoto It is certified that error appears in the above-identified patent and that said Letters Patent is hereby corrected as shown below:

On the Title Page, Item (63) should be corrected to read

(63) Continuation of application No. 12/388,575, filed on Feb. 19, 2009, now Pat. No. 8,179,249

Signed and Sealed this
Fourteenth Day of May, 2013

Teresa Stanek Rea
*Acting Director of the United States Patent and Trademark Office*